US009781518B2

(12) United States Patent
Schober et al.

(10) Patent No.: US 9,781,518 B2
(45) Date of Patent: Oct. 3, 2017

(54) MEMS MICROPHONE ASSEMBLY AND METHOD OF OPERATING THE MEMS MICROPHONE ASSEMBLY

(75) Inventors: Armin Schober, München (DE); Gino Rocca, Copenhagen (DK); Troels Andersen, Smorum (DK)

(73) Assignee: TDK Corporation, Tokyo (JP)

( * ) Notice: Subject to any disclaimer, the term of this patent is extended or adjusted under 35 U.S.C. 154(b) by 178 days.

(21) Appl. No.: 14/399,897

(22) PCT Filed: May 9, 2012

(86) PCT No.: PCT/EP2012/058570
§ 371 (c)(1),
(2), (4) Date: Jan. 28, 2015

(87) PCT Pub. No.: WO2013/167183
PCT Pub. Date: Nov. 14, 2013

(65) Prior Publication Data

US 2015/0131812 A1 May 14, 2015

(51) Int. Cl.

| | |
|---|---|
| ***H04R 3/00*** | (2006.01) |
| ***H04R 17/02*** | (2006.01) |
| ***H04R 1/04*** | (2006.01) |
| ***H04R 19/00*** | (2006.01) |
| ***H04R 29/00*** | (2006.01) |
| ***H04R 1/08*** | (2006.01) |
| *H04R 19/04* | (2006.01) |

(52) U.S. Cl.
CPC ..... *H04R 17/02* (2013.01); *H04R 1/04* (2013.01); *H04R 1/08* (2013.01); *H04R 19/005* (2013.01); *H04R 29/004* (2013.01); *H04R 3/007* (2013.01); *H04R 19/04* (2013.01)

(58) Field of Classification Search
CPC .... H04R 17/02; H04R 19/005; H04R 29/004; H04R 3/007
See application file for complete search history.

(56) References Cited

U.S. PATENT DOCUMENTS

| | | | |
|---|---|---|---|
| 4,631,749 | A | 12/1986 | Rapaich |
| 8,036,401 | B2 | 10/2011 | Poulsen et al. |
| 8,515,100 | B2 | 8/2013 | Shajaan et al. |

(Continued)

FOREIGN PATENT DOCUMENTS

| | | | |
|---|---|---|---|
| EP | 1906704 | A1 | 4/2008 |
| JP | 200835310 | A | 2/2008 |
| JP | 2009502062 | A | 1/2009 |

*Primary Examiner* — Joseph Saunders, Jr.
*Assistant Examiner* — James Mooney
(74) *Attorney, Agent, or Firm* — Slater Matsil, LLP

(57) ABSTRACT

A MEMS microphone assembly includes a MEMS transducer element having a back plate and a diaphragm displaceable relative to the back plate. A bias voltage generator is adapted to provide a DC bias voltage applicable between the diaphragm and the back plate. An amplifier receives an electrical signal from the MEMS transducer element and provides an output signal. The amplifier is adapted to amplify the electrical signal from the MEMS transducer element according to an amplifier gain setting. A processor is adapted to carry out a calibration routine at power-on of the microphone assembly determining information regarding the DC bias voltage and/or the amplifier gain setting.

16 Claims, 3 Drawing Sheets

(56) References Cited

U.S. PATENT DOCUMENTS

| | | | | |
|---|---|---|---|---|
| 2008/0075306 | A1* | 3/2008 | Poulsen | H04R 19/005 381/111 |
| 2010/0002543 | A1 | 1/2010 | Schlosser et al. | |
| 2010/0135501 | A1 | 6/2010 | Corbett et al. | |
| 2010/0219839 | A1 | 9/2010 | Steele et al. | |
| 2011/0075859 | A1 | 3/2011 | Kim et al. | |
| 2011/0075865 | A1* | 3/2011 | Yang | H04R 19/005 381/174 |
| 2013/0136267 | A1* | 5/2013 | Hammerschmidt | H04R 3/06 381/58 |

* cited by examiner

MEMS MICROPHONE ASSEMBLY AND METHOD OF OPERATING THE MEMS MICROPHONE ASSEMBLY

This patent application is a national phase filing under section 371 of PCT/EP2012/058570, filed May 9, 2012, which is incorporated herein by reference in its entirety.

TECHNICAL FIELD

The present invention concerns a MEMS microphone assembly comprising a MEMS transducer element comprising a back plate and a diaphragm displaceable in relation to the back plate and a controllable bias voltage generator adapted to provide a DC bias voltage between the diaphragm and the back plate. Further, the present invention concerns a method of operating the MEMS microphone assembly.

BACKGROUND

A significant problem in producing MEMS condenser microphones with high yield is that the compliance and tension of the MEMS microphone diaphragm varies from one microphone to another.

Methods to calibrate the microphone after the fabrication process is completed are known. European Patent No. EP 1 906 704 A1 and U.S. Pat. No. 8,036,401 B2 disclose a method wherein the microphone is calibrated in a last step of the production process using an external reference sound source. However, this method has some disadvantages. It requires a high test effort and additional pins to read in the calibration results to the microphone. Moreover, it requires a non-volatile memory which is able to store the information determined in the calibration process even if the microphone is powered off. Such a non-volatile memory is expensive, space-consuming and difficult to realize in an integrated circuit.

SUMMARY OF THE INVENTION

According to one aspect, the MEMS microphone assembly comprises a MEMS transducer element comprising a back plate and a diaphragm displaceable in relation to the back plate, a bias voltage generator adapted to provide a DC bias voltage applicable between the diaphragm and the back plate, an amplifier for receiving an electrical signal from the MEMS transducer element and for providing an output signal, the amplifier being adapted to amplify the electrical signal from the MEMS transducer element according to an amplifier gain setting, and a processor adapted to carry out a calibration at power-on of the microphone assembly determining information regarding the DC bias voltage and/or the amplifier gain setting.

The amplifier may be a preamplifier. The amplifier may be controllable such that its amplifier gain setting may be altered and set to different levels.

The DC bias voltage generator may be controllable such that the magnitude of the generated DC voltage may be set to different values.

As the calibration routine is carried out every time the microphone assembly is powered on, the calibration routine is able to consider aging or environmental impacts which change the sensitivity of the microphone assembly and widen the tolerance of the microphone assembly after the production process has been completed. For example, a solder process might change the sensitivity of a microphone assembly if it is carried out after the production of the microphone is completed, e.g., when the microphone assembly is built into a mobile phone. Accordingly, the present invention allows compensating changes in the sensitivity of the microphone assembly or the spread of other parameters affecting the overall sensitivity of the microphone assembly even after the fabrication process has been completed.

In general, the sensitivity of the MEMS microphone assembly depends to a great extent on the tolerance of the bias voltage generator and on the sensitivity tolerance of the MEMS transducer element. Further, the sensitivity tolerance of the MEMS transducer element is mostly determined by the voltage applied between the diaphragm and the back plate. In case this voltage exceeds a certain value the diaphragm will physically touch the backplate, this is known as a collapse event. And the voltage where it happens is called the collapse voltage.

The tolerance of the bias voltage generator depends on an ASIC process and cannot easily be reduced further with economic designs. Instead, the calibration routine which is carried at power-on of the microphone assembly allows measuring an optimized bias voltage setting. For this purpose, the bias voltage setting of the generator may be determined which corresponds to a collapse event.

The present MEMS microphone assembly is enabled to carry out a calibration routine of the bias voltage necessary to trigger a collapse event. The calibration routine allows choosing a gain setting of the amplifier and/or a bias voltage setting of the bias voltage generator such that any variations in the fabrication of the MEMS microphone assembly can be balanced out. In particular, the voltage corresponding to a collapse event of the MEMS transducer element and the voltage provided by the bias voltage generator are subject to variations in the fabrication from one MEMS microphone assembly to another. To allow for a good performance of the MEMS microphone assembly, a certain tolerance of the assembly should not be exceeded.

However, it is not necessary for the calibration routine to measure the exact value of the bias voltage necessary to trigger the collapse event. Instead, the calibration routine may determine the setting of the bias voltage generator providing a bias voltage triggering the collapse event. Thereby, the tolerance of the bias voltage generator can be balanced out without knowing the exact voltage provided by the bias voltage generator.

Moreover, the processor carries out the calibration routine by using electrical signals only. Accordingly, no external sound source is required for the calibration routine. Thereby, a complicated and costly testing stage is no longer required. Furthermore, additional pins that would otherwise be needed to provide information from the outside to the microphone regarding the results of the calibration routine are no longer necessary. Instead, the calibration routine happens internally in the microphone.

However, one of the DC bias voltage generator and the amplifier may not be controllable in alternate embodiments. In one embodiment, the DC bias voltage generator may provide a fixed bias voltage. In this embodiment, the gain setting of the amplifier is variable. In particular, the gain setting may be chosen such that the tolerance of the MEMS microphone assembly is kept.

In another embodiment, the amplifier may have a fixed gain setting. However, in this embodiment, the bias voltage generator is controllable. The bias voltage setting may be chosen such that the tolerance of the MEMS microphone assembly is kept.

In one embodiment, the processor is adapted to set the amplifier gain setting and/or the DC bias voltage applied by the voltage generator in accordance with the information determined in the calibration routine.

Preferably, the gain of the amplifier is adjustable by altering electrical parameters of the circuit components like resistors and capacitors, and components of a feedback circuit, coupled to the amplifier. Amplifiers may be merely single transistor amplifiers or buffers, preferably based on a CMOS transistor, or maybe more complex circuits such as multistage operational amplifiers.

In a preferred embodiment, the MEMS microphone comprises a volatile memory for storing information. In particular, the information determined during the calibration routine may be stored in the volatile memory. Further, the gain setting and the DC bias voltage may be set according to this information. As the calibration routine is carried out every time the microphone assembly is powered on, the memory can be volatile. It is not necessary to store the information when the microphone is powered off. Instead, new sensitivity information is determined every time the microphone is powered on, thereby also considering environmental and aging effects.

Moreover, compared to a non-volatile memory, a volatile memory provides some important advantages. In particular, a volatile memory is cheaper and easier to realize in an integrated circuit.

Moreover, the processor may be adapted to store the information determined in the calibration routine in the volatile memory.

In one embodiment, the processor may be adapted to retrieve the information from the volatile memory and to control the gain of the amplifier and/or the DC bias voltage of the voltage generator in accordance with the information from the volatile memory.

Moreover, the MEMS microphone assembly may comprise a test generator enabled to provide an electrical signal to the controllable amplifier. The test generator may simulate a signal from the transducer element. However, the signal from the test generator is well-known such that the gain of the amplifier may be observed by observing the output only.

The microphone assembly may further comprise a switch which can connect the amplifier to the test generator.

Further, in one embodiment, the MEMS microphone assembly further comprises an additional backplate wherein the diaphragm is placed in between the backplate and the additional backplate. Dual backplate MEMS microphones provide an improved sensitivity. A first bias voltage may be applied between the first back plate and the diaphragm and a second bias voltage may be applied between the second back plate and the diaphragm. The herein described method to determine the optimal bias voltage may be used twice in this case, once to determine the first bias voltage and once to determine the second bias voltage.

According to a second aspect of the present invention, a method of operating the MEMS microphone assembly comprises a calibration routine and an operation phase, wherein the calibration routine is carried out after powering on of the microphone assembly and information regarding a DC bias voltage setting of the voltage generator and/or the gain setting of the amplifier is determined in the calibration routine and wherein the operation phase is carried out after the calibration routine and the DC bias voltage and/or the gain setting of the amplifier is set in the operation phase according to the information determined during the calibration routine.

In one embodiment, the calibration routine comprises the steps of: setting the DC bias voltage applied by the voltage generator to a starting value, stepwise incrementing the DC bias voltage until a collapse is detected, and storing a DC bias voltage setting wherein the DC bias voltage is set to a voltage smaller than the collapse voltage.

In particular, it is not necessary to determine the exact numerical value of the bias voltage applied to the transducer element which corresponds to the collapse event. Instead, the present method determines the setting of the voltage generator which corresponds to the collapse event.

In particular, the initial starting value of the DC voltage applied by the voltage generator may not even be exactly known due to the tolerance of the bias voltage generator. Accordingly, the applied DC voltage does not need to be known on an absolute scale. Instead, it is enough to know the setting of the voltage generator on a relative scale.

In one embodiment, the DC bias voltage setting is determined based on the number of increments that have been carried out until the collapse event has been detected. The DC bias voltage setting may be determined with the help of a look-up table wherein the number of increments is used as an input parameter. Alternatively, a predefined ratio of the number of increments may correspond to the chosen DC bias voltage setting.

Again, it is not necessary to know the exact value of the bias voltage during the operation phase.

Further, the calibration routine can comprise the steps of providing an electrical test signal from a test generator to the amplifier, and determining an optimal value for the gain setting of the amplifier by stepwise increasing the gain and by measuring the output signal of the amplifier.

In particular, the optimal value for the gain setting gives a desired amplifier gain. This value may be determined by stepwise increasing the gain and by detecting in each step whether the amplitude of the amplifier output has reached the desired magnitude.

BRIEF DESCRIPTION OF THE DRAWINGS

In the following, a preferred embodiment of the invention will be described with reference to the drawings, wherein.

DETAILED DESCRIPTION OF ILLUSTRATIVE EMBODIMENTS

Figure 1:
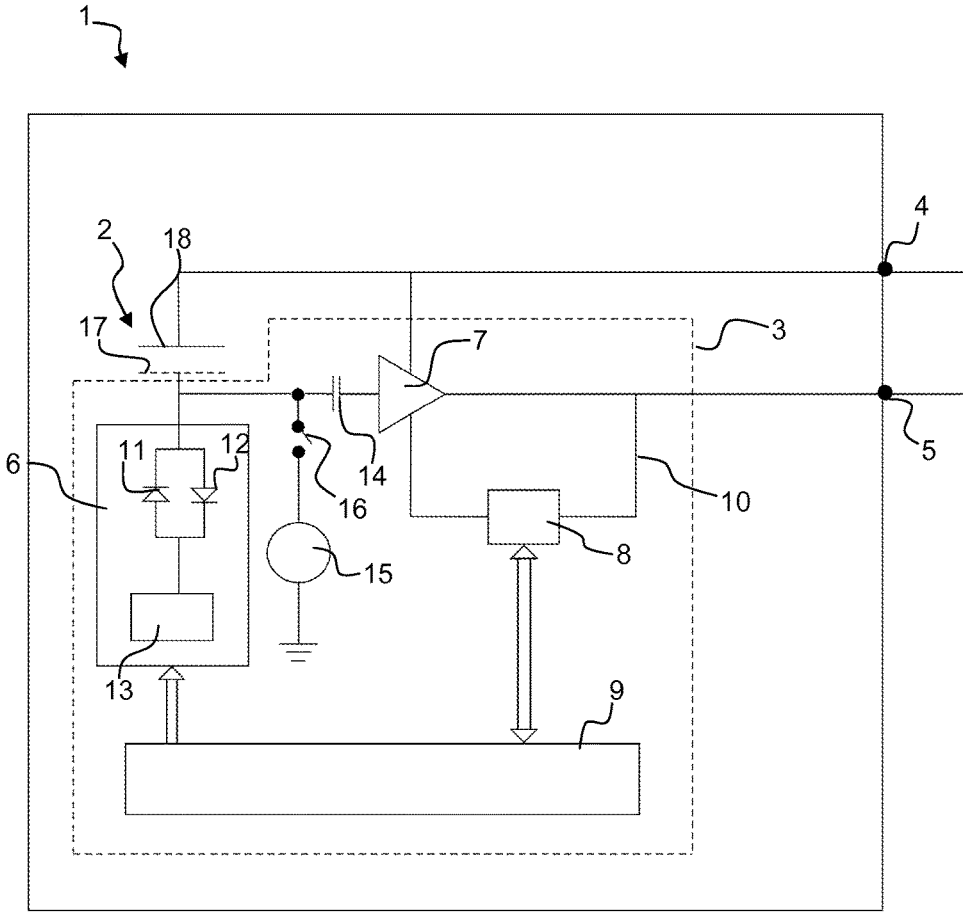
FIG. 1 shows an embodiment of a MEMS microphone assembly.

FIG. 1 schematically shows a MEMS microphone assembly 1. The MEMS microphone assembly 1 comprises a MEMS transducer element 2 and an integrated circuit portion 3. In addition the MEMS microphone assembly 1 has an input terminal 4 for applying a voltage supply and an output terminal 5.

The MEMS transducer element 2 comprises a back plate 17 and a diaphragm 18 displaceable in relation to the back plate 17.

The integrated circuit portion 3 comprises a controllable bias voltage generator 6, a preamplifier 7, a processor 8 and a memory 9.

The integrated circuit portion 3 may further comprise a second voltage generator providing a constant regulation voltage which is not shown in FIG. 1. The second voltage generator may apply the regulation voltage to one of the back plate 17 or the displaceable diaphragm 18 of the transducer element 2.

The processor 8 is adapted to set at least one of a gain setting of the preamplifier 7 and the DC bias voltage applied by the voltage generator 6. Preferably, the DC bias voltage generator 6 and the preamplifier are both controllable and the processor 8 is adapted to set both the gain setting of the preamplifier 7 and the DC bias voltage applied by the voltage generator 6. However, in an alternate embodiment, the DC bias voltage generator may provide a DC bias voltage with constant amplitude. In this case, the processor 8 may set only the gain setting of the preamplifier 7. In another alternate embodiment, the preamplifier 7 may have a fixed gain setting and the processor is enabled to set the DC bias voltage of the controllable voltage generator 6.

In the preferred embodiment, the preamplifier 7 comprises an input for data for adjusting the gain setting of the preamplifier 7. The preamplifier 7 is connected to the processor 8 via a feedback loop 10. Further, the processor 8 is connected to the memory 9. In particular, the processor 8 is enabled to write information into the memory 9 and to read out information from the memory 9.

In particular, the processor 8 is adapted to carry out a calibration routine of the microphone assembly 1 by determining information regarding the preamplifier gain setting. Further, the processor 8 is adapted to store said information in the memory 9. Moreover, the processor 8 is also adapted to read out said information from the memory 9 and to adapt the gain setting of the preamplifier 7 accordingly.

In this embodiment, the DC bias voltage generator 6 comprises two cross-coupled diodes 11, 12 and a Dickson pump 13 having an input for data for regulating the voltage output of the generator 6. The operation of the Dickson pump 13 is a direct conversion of the information of the memory 9. The information may be read out from the memory 9 directly by the DC bias voltage generator 6 or by the processor 8. In the later case, the processor 8 is enabled to set the DC bias voltage provided by the generator 6.

Moreover, the use of other types of DC bias voltage generators 6 is also possible.

Further, the integrated circuit portion 3 comprises a coupling capacitor 14 which is connected in series between the transducer element 2 and the preamplifier 7.

Moreover, the integrated circuit portion 3 comprises a test generator 15. The test generator is enabled to provide a constant and well-defined signal. The circuit portion 3 further comprises a switch 16 enabling to connect the preamplifier 7 to the test generator 15. The preamplifier 7 may be connected to the test generator 15, e.g., during a part of a calibration routine wherein the optimal gain setting of the preamplifier 7 is measured. During calibration of the amplifier, the test generator may be used to provide a well-known signal to the amplifier. Thereby, a deviation of the amplifier may be examined independently from any deviations caused by the transducer element. However, during an operation phase of the microphone assembly 1, the switch 16 is opened and the preamplifier 7 is separated from the test generator 15. Accordingly the preamplifier 7 connected only to the transducer element 2.

Preferably, the memory 9 is a volatile memory, i.e., it requires power to maintain stored information. After powering off of the microphone assembly 1 the stored information will be lost. A volatile memory provides the advantage over a non-volatile memory that it is simpler to realize in an integrated circuit. Volatile memory is also cheaper and less space-consuming the non-volatile memory.

The processor 8 is enabled to set the gain setting of the preamplifier 7 and further to carry out a calibration routine of the microphone assembly 1. In the calibration routine the DC voltage applied to the transducer element 2 by the voltage generator 6 is determined and, further, the gain setting of the preamplifier 7 is also determined. The calibration routine is carried out every time the microphone assembly 1 is powered on. The information determined in the calibration routine is stored in the volatile memory 9. As the calibration routine is carried out every time during powering on, the memory 9 does not need to be non-volatile as the information is determined again every time at power-on.

This provides the advantage that changes in the sensitivity of the microphone assembly due to aging or environmental impact can be taken care of, which is not possible if a calibration routine is carried out only one time at the end of a fabrication process. An example of an environmental impact is a reflow solder process which is carried out during assembly of the final device, e.g., in a mobile phone. Another advantage is that the volatile memory is easier to realize as a hardware component in an integrated circuit and thereby allows for the construction of a smaller microphone assembly.

The calibration routine comprises two steps. In the first step, the optimal value of the bias voltage applied by the voltage generator 6 to the transducer element 2 is determined. In the second step, the optimal gain setting of the preamplifier 7 is determined. However, in embodiments with a voltage generator 6 providing a fixed level of DC bias voltage only the second step of the calibration routine is carried out. Further, in embodiment comprising a preamplifier 7 with a fixed gain setting only the first step of the calibration routine is carried out.

After the calibration routine is completed, an operation phase of the microphone assembly 1 may be started.

Figure 2:
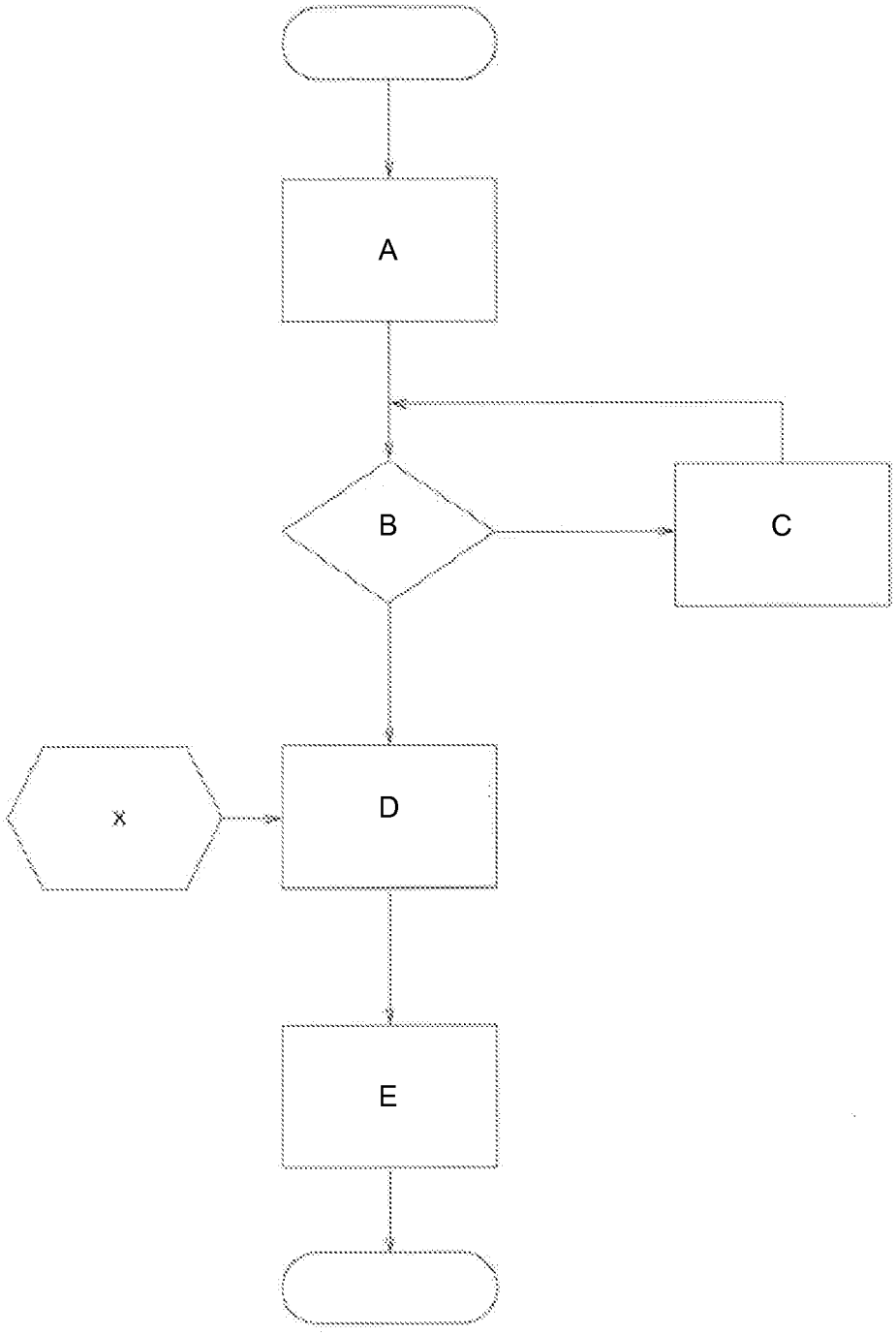
FIG. 2 shows a flowchart of a first step of a calibration routine.

FIG. 2 shows a flowchart showing the first step of the calibration routine. During the first step of the calibration routine, the switch 16 is open such that the preamplifier 7 is electrically not connected to the test generator 15. However, the preamplifier 7 is connected to the transducer element 2. In a step A of the first step a minimal bias voltage is applied by the controllable bias voltage generator 6 to the transducer element 2. This minimal voltage may be, e.g., around 9 V. However, it is not necessary to know the exact value of the minimum bias voltage applied to the transducer element 2.

After step A, step B is carried out. In step B, it is determined whether or not a collapse event can be detected. The collapse event is triggered if the voltage applied between the displaceable diaphragm 18 and the back plate 17 of the transducer element 2 is high enough to exert a force on the diaphragm 18 such that the diaphragm 18 pulled so far towards the back plate 17 that it directly contacts the back plate 17.

If no collapse event is detected in step B, step C is carried out. Step C corresponds to incrementing the bias voltage by a fixed value, e.g., by 0.1 V. However, it is not necessary to know the exact value of the increment. Moreover, a counter is counting how many times step C is carried out until the collapse event is detected. Again, step B is carried out afterwards, i.e. it is checked if a collapse event can be detected. Steps B, C are repeated until a collapse event is detected.

In this case, step D is carried out. In step D, the optimal bias voltage setting for the bias voltage generator is determined. This setting can be deduced from the number of cycles step C has been carried out. The number of cycles of step C is read out as parameter x from the counter.

Based on this parameter x the setting of the bias voltage generator is determined. The setting can be chosen with the help of a look-up table wherein a setting is attributed to each possible value of parameter x.

However, it is not necessary to know the exact numerical value of the bias voltage corresponding to the collapse event. Instead, it is sufficient to know the setting of the bias voltage generator 6 corresponding to the collapse event.

For example, the bias voltage generator may provide various settings on an arbitrary scale. In step A a minimal bias voltage is applied. Afterwards, in step C of the calibration routine, the bias voltage is incremented by an unknown increment x times. Further, in step D, the bias voltage setting for the operation mode is determined to be the minimal bias voltage plus y times the increment wherein y is smaller than x. Given a number x of increments carried out until a collapse event is detected as an input parameter, the look-up table allocates the setting y of the DC bias voltage. The setting may alternatively be calculated as a fixed ratio of x.

Once the optimal bias voltage is determined, this value is stored in the volatile memory 9 in step E such that it can be read out later in the operation phase of the microphone assembly 1.

Figure 3:
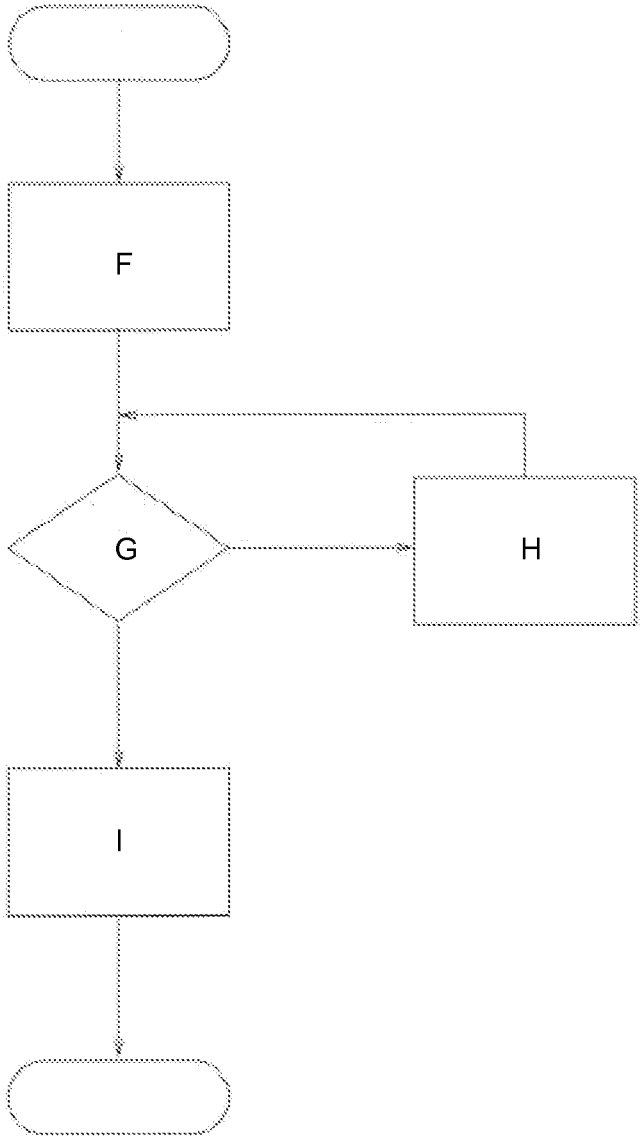
FIG. 3 shows a flowchart of a second step of a calibration routine.

After the first step of the calibration routine is completed, the second step of the calibration routine is carried out determining the optimal gain setting of the preamplifier 7. FIG. 3 shows a flow chart of said second step.

In the second step, the switch 16 connects the preamplifier to the generator 15. Thereby, it is ensured that a constant signal is applied to the preamplifier 7. The second step of the calibration routine begins with step F, setting the gain to a minimum value, e.g., 6 dB. In step G, the output signal of the preamplifier 7 is observed and it is determined if a peak of the magnitude of the output signal is equal to or greater than a preset value. If not, step H is carried out wherein the gain is incremented. If so, step I is carried out wherein the gain setting is stored in the volatile memory 9.

After the second step of the calibration routine is completed, the calibration routine is finished. Now the operation phase of the microphone assembly 1 may be started. In the operation phase the processor 8 reads out the optimal gain setting and the optimal bias voltage from the volatile memory 9 and sets the preamplifier 7 and the voltage generator 6 according to this information.

We claim:

1. A MEMS microphone assembly comprising:

a MEMS transducer element comprising a back plate and a diaphragm displaceable relative to the back plate;

a bias voltage generator connected to provide a DC bias voltage between the diaphragm and the back plate;

an amplifier coupled to the MEMS transducer element to receive an electrical signal and to provide an output signal, the amplifier being adapted to amplify the electrical signal from the MEMS transducer element according to an amplifier gain setting; and a processor adapted to carry out a calibration routine at power-on of the MEMS microphone assembly to determine information regarding the DC bias voltage and/or the amplifier gain setting, wherein the calibration routine is carried out every time the microphone assembly is powered on, and wherein the information determined in the calibration routine is not stored when the microphone assembly is powered off.

2. The MEMS microphone assembly according to claim 1, wherein the processor is further adapted to set the amplifier gain setting and/or the DC bias voltage applied by the voltage generator in accordance with the information determined in the calibration routine.

3. The MEMS microphone assembly according to claim 1, further comprising a volatile memory coupled to the processor.

4. The MEMS microphone assembly according to claim 3, wherein the processor is adapted to store the information determined in the calibration routine in the volatile memory.

5. The MEMS microphone assembly according to claim 3, wherein the processor is adapted to retrieve the information from the volatile memory and to control a gain of the amplifier and/or the DC bias voltage of the voltage generator in accordance with the information from the volatile memory.

6. The MEMS microphone assembly according to claim 1, further comprising a test generator enabled to provide an electrical signal to the amplifier.

7. The MEMS microphone assembly according to claim 1, further comprising an additional backplate, wherein the diaphragm is located between the backplate and the additional backplate.

8. A method of operating a MEMS microphone, the method comprising:

powering on the MEMS microphone, which includes a MEMS transducer element comprising a back plate and a diaphragm displaceable relative to the back plate;

performing a calibration routine after powering on the MEMS microphone to determine calibration information regarding a DC bias voltage and/or a gain setting of an amplifier coupled to receive an electrical signal from the MEMS transducer element and to amplify the electrical signal from the MEMS transducer element according to the gain setting; and performing an operation phase after performing the calibration routine, wherein the DC bias voltage is applied between the diaphragm and the back plate and/or the gain setting of the amplifier is set in the operation phase according to the information determined during the calibration routine, wherein the calibration routine is performed every time the MEMS microphone is powered on, and wherein the information determined in the calibration routine is not stored when the MEMS microphone is powered off.

9. The method according to claim 8, wherein the calibration routine determines information regarding the DC bias voltage and the DC bias voltage is applied between the diaphragm and the back plate during the operation phase.

10. The method according to claim 9, wherein the calibration routine also determines the gain setting of the amplifier and the gain setting of the amplifier is set in the operation phase.

11. The method according to claim 9, wherein the calibration routine comprises:

setting the DC bias voltage applied by a voltage generator to a starting value;

stepwise incrementing the DC bias voltage until a collapse is detected; and storing a DC bias voltage setting, wherein the DC bias voltage is set to a voltage smaller than the collapse voltage.

12. The method according to claim 11, wherein the DC bias voltage setting is determined based on a number of increments.

13. The method according to claim 8, wherein the calibration routine determines the gain setting of the amplifier and the gain setting of the amplifier is set in the operation phase.

14. The method according to claim 13, wherein the calibration routine comprises:

providing an electrical test signal to the amplifier; and determining the gain setting of the amplifier by stepwise increasing the gain and measuring an output signal of the amplifier.

15. The method of claim 14, wherein the gain setting is determined by stepwise increasing the gain and, for each step, detecting whether an amplitude of the output signal of the amplifier has reached a desired magnitude.

16. The method according to claim 8, further comprising storing the calibration information in a volatile memory; and at a beginning of the operation phase, retrieving the information from the volatile memory and setting the DC bias voltage and/or the gain of the amplifier according to the calibration information.

* * * * *